US010928762B2

(12) United States Patent
Taguchi et al.

(10) Patent No.: US 10,928,762 B2
(45) Date of Patent: Feb. 23, 2021

(54) FIXING DEVICE

(71) Applicant: BROTHER KOGYO KABUSHIKI KAISHA, Nagoya (JP)

(72) Inventors: Kazuna Taguchi, Nagoya (JP); Tomonori Watanabe, Ichinomiya (JP); Kenji Takeuchi, Nagoya (JP); Hiroshi Handa, Inazawa (JP); Mingguang Zhang, Nagoya (JP); Shuhei Fukue, Nagoya (JP); Hirotaka Imaeda, Komaki (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/729,693

(22) Filed: Dec. 30, 2019

(65) Prior Publication Data

US 2020/0272079 A1 Aug. 27, 2020

(30) Foreign Application Priority Data

Feb. 22, 2019 (JP) ..... JP2019-030311
Feb. 22, 2019 (JP) ..... JP2019-030313
Mar. 28, 2019 (JP) ..... JP2019-062290

(51) Int. Cl.
*G03G 15/20* (2006.01)

(52) U.S. Cl.
CPC ..... *G03G 15/2053* (2013.01)

(58) Field of Classification Search
CPC ... G03G 2215/2009; G03G 2215/2041; G03G 15/2053; G03G 15/2017; G03G 15/206; B65H 2404/25; B65H 2404/254; B65H 2801/03–15
See application file for complete search history.

(56) References Cited

U.S. PATENT DOCUMENTS 5,809,389 A * 9/1998 Tamura ..... G03G 15/206 399/322
8,983,352 B2 * 3/2015 Sasaki ..... G03G 15/2053 399/329
9,411,273 B1 * 8/2016 Takahashi ..... G03G 15/2007
(Continued)

FOREIGN PATENT DOCUMENTS

JP 2010-231008 A 10/2010
JP 2011-203462 A 10/2011
(Continued)

*Primary Examiner* — Walter L Lindsay, Jr.
*Assistant Examiner* — Arlene Heredia
(74) *Attorney, Agent, or Firm* — Merchant & Gould P.C.

(57) ABSTRACT

A device includes a rotator, a belt facing the rotator and having an outer peripheral surface which contacts the rotator to form a nip therebetween, a first pad configured to press the belt toward the rotator to form one part of the nip, a second pad configured to press the belt toward the rotator, to form another part of the nip, a holder holding the first pad and the second pad, a stay supporting the holder, and an urging member urging the stay toward the rotator in an urging direction. The second pad is located upstream of the first pad in a conveyance direction in the nip orthogonal to the urging direction. At least a portion of a contact area between the stay and the holder is located downstream of a center of the nip and upstream of a front edge of the first pad in the conveyance direction.

18 Claims, 14 Drawing Sheets

(56) References Cited

U.S. PATENT DOCUMENTS

| | | | | |
|---|---|---|---|---|
| 9,488,942 | B2 * | 11/2016 | Ishimori | G03G 15/2032 |
| 9,791,811 | B2 * | 10/2017 | Imazu | G03G 15/2028 |
| 9,835,996 | B2 * | 12/2017 | Nagai | G03G 15/2025 |
| 9,857,735 | B1 * | 1/2018 | Yamada | G03G 15/2057 |
| 10,365,596 | B1 * | 7/2019 | Tanaka | G03G 15/2064 |
| 10,539,911 | B1 * | 1/2020 | Imazu | G03G 15/2028 |
| 2010/0247186 | A1 * | 9/2010 | Tanaka | G03G 15/206 399/329 |
| 2011/0236087 | A1 | 9/2011 | Yagi et al. | |
| 2016/0259282 | A1 * | 9/2016 | Komatsu | G03G 15/206 |

FOREIGN PATENT DOCUMENTS

| | | | |
|---|---|---|---|
| JP | 2016-57527 | A | 4/2016 |
| JP | 2017-68053 | A | 4/2017 |

* cited by examiner

FIXING DEVICE

CROSS-REFERENCE TO RELATED APPLICATION

This application claims priority from Japanese Patent Application No. 2019-030313 and Japanese Patent Application No. 2019-030311 both of which were filed on Feb. 22, 2019, as well as Japanese Patent Application No. 2019-062290 filed on Mar. 28, 2019, the content of which is incorporated herein by reference in its entirety.

TECHNICAL FIELD

Aspects of the disclosure relate to a fixing device including a rotator and a belt, and an image forming apparatus including the fixing device.

BACKGROUND

A known image forming apparatus includes a fixing device. The fixing device includes a heat roller, a belt, an upstream pad, a downstream pad, a pad holder, a first stay, a second stay, and springs. The upstream pad and the downstream pad press the belt against the heat roller, thus forming a nip. The pad holder holds the upstream pad and the downstream pad. The first stay and the second stay support the pad holder. The springs urge the first stay and the second stay toward the heat roller. The fixing device fixes a toner image onto a sheet passing through the nip by heating and melting toner on the sheet and applying pressure to the sheet.

SUMMARY

According to one aspect of the disclosure, a device includes a rotator, a belt, a first pad, a second pad, a stay, a holder, and an urging member. The belt faces the rotator and has an outer peripheral surface which is configured to contact the rotator to form a nip therebetween. The first pad is configured to press the belt toward the rotator to form one part of the nip. The second pad is configured to press the belt toward the rotator, to form another part of the nip. The holder holds the first pad and the second pad. The stay supports the holder. The urging member urges the stay toward the rotator in an urging direction. The second pad is located upstream of the first pad in a conveyance direction in the nip orthogonal to the urging direction. At least a portion of a contact area between the stay and the holder is located downstream of a center of the nip and upstream of a front edge of the first pad in the conveyance direction.

According to another aspect of the disclosure, a fixing device includes a roller, a heater, a belt, a first pad, a second pad, a holder, and a stay. The roller has a rotation axis extending in an axial direction. The heater is positioned within the roller. The belt faces the roller and has an outer peripheral surface which is configured to contact the roller to form a nip therebetween. The first pad is configured to press the belt toward the roller to form one part of the nip. The second pad is configured to press the belt toward the rotator, to form another part of the nip. The holder holds the first pad and the second pad. The stay supports the holder. The stay receives an urging force urging the stay toward the rotator in an urging direction. The second pad is located upstream of the first pad in a conveyance direction in the nip orthogonal to the urging direction and the axial direction. A contact area between the stay and the holder is located entirely downstream of the second pad and at least partially upstream of the first pad in the conveyance direction.

DETAILED DESCRIPTION

1. Overview of Image Forming Apparatus

Figure 1:
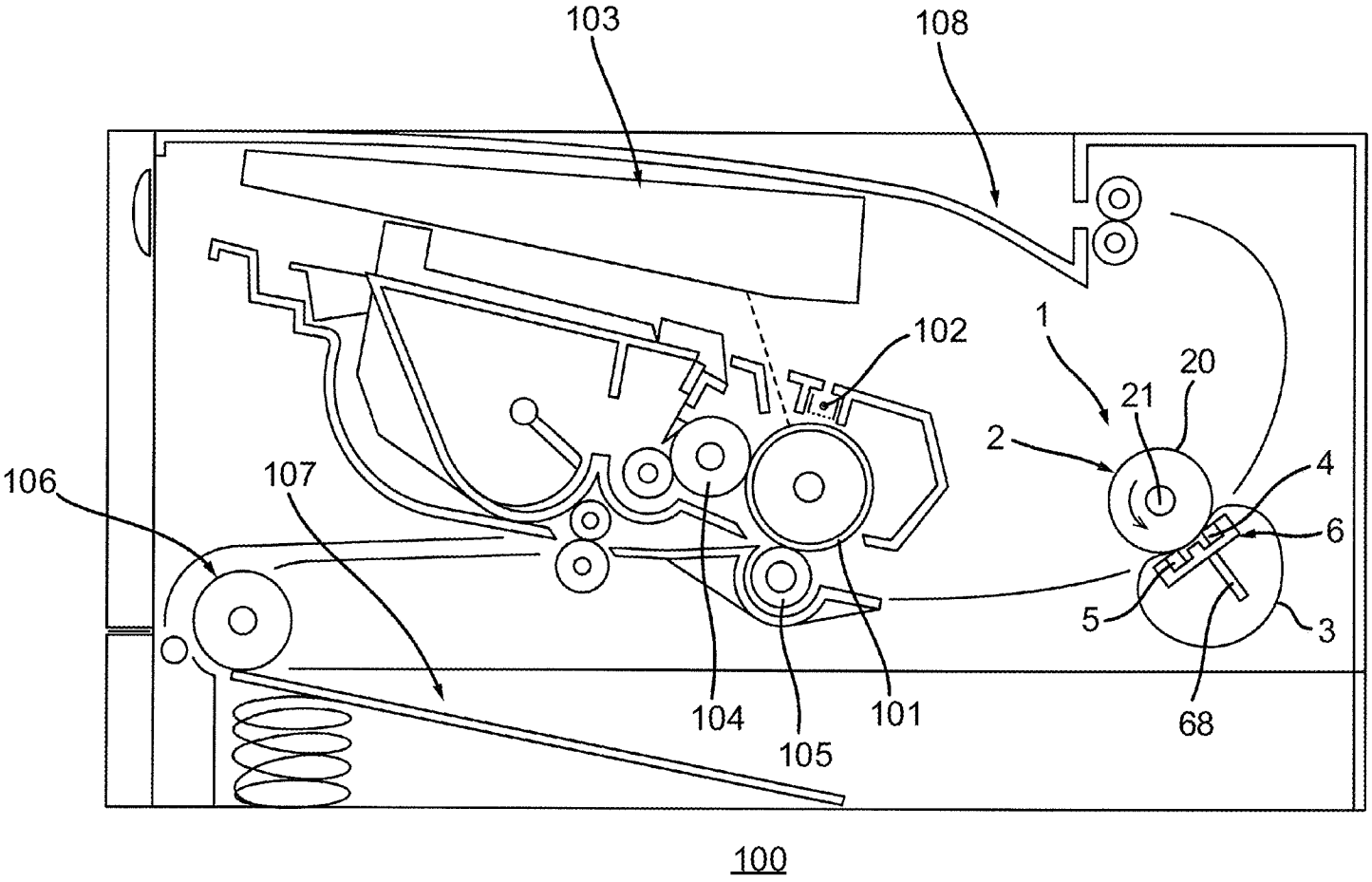
FIG. 1 is a cross sectional view of an image forming apparatus including a fixing device according to a first embodiment of the disclosure.

As illustrated in FIG. 1, a fixing device 1 is disposed in an image forming apparatus 100. An overview of the image forming apparatus 100 will be described.

The image forming apparatus 100 includes a photosensitive drum 101, a charger 102, a laser scan unit 103, a developing roller 104, a transfer roller 105, the fixing device 1, a sheet feed mechanism 106, a sheet feed tray 107, and a sheet discharge tray 108.

The charger 102 charges a surface of the photosensitive drum 101. The laser scan unit 103 exposes the surface of the photosensitive drum 101 charged by the charger 102. The surface of the photosensitive drum 101 thus carries an electrostatic latent image thereon. The developing roller 104 supplies toner to the surface, having the electrostatic latent image thereon, of the photosensitive drum 101. The surface of the photosensitive drum 101 thus carries a toner image thereon. The sheet feed mechanism 106 feeds a sheet from the sheet feed tray 107 toward between the photosensitive drum 101 and the transfer roller 105. The transfer roller 105 transfers the toner image on the surface of the photosensitive drum 101 onto the sheet. The fixing device 1 fixes the toner image onto the sheet by heating and melting toner and applying pressure to the sheet. After passing through the fixing device 1, the sheet is discharged onto the sheet discharge tray 108.

2. Detailed Description of Fixing Device

Figure 2:
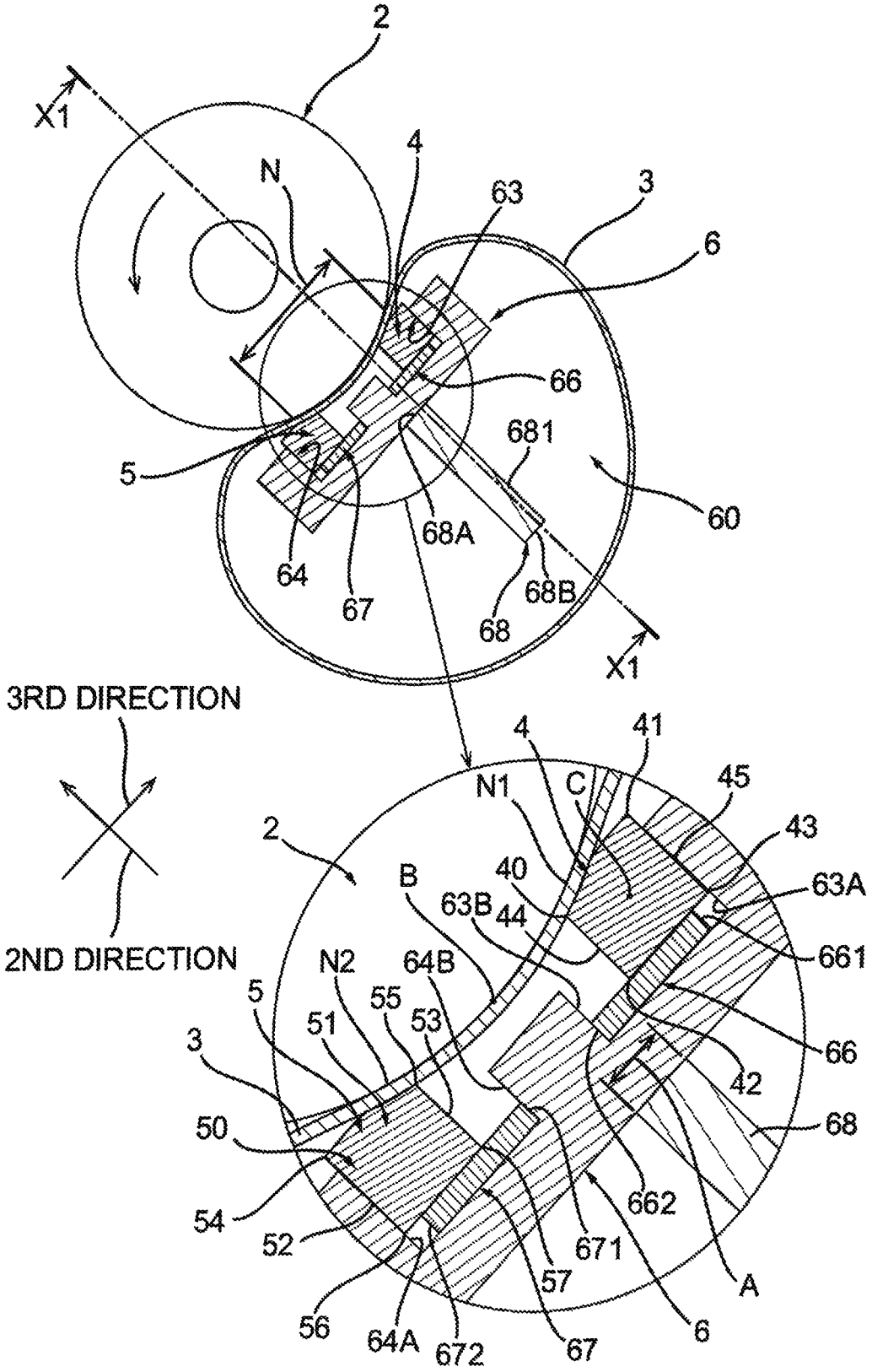
FIG. 2 is a cross sectional view of the fixing device illustrated in FIG. 1.
Figure 3:
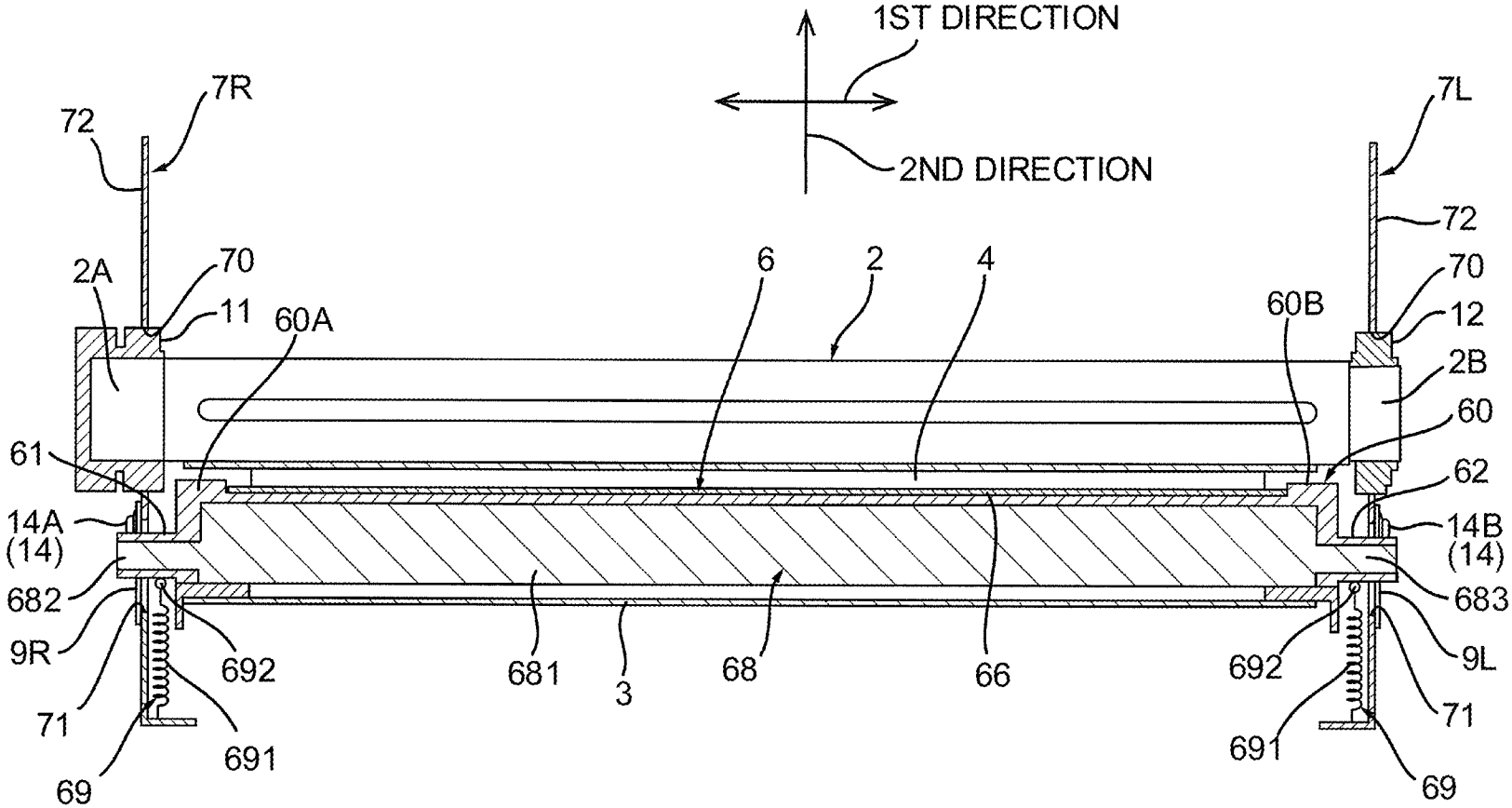
FIG. 3 is a cross sectional view of the fixing device taken along a line X1-X1 of FIG. 2.

As illustrated in FIGS. 1-3, the fixing device 1 includes a heat roller 2 as an example of a rotator, a belt 3, a downstream pad 4 as an example of a first pad, an upstream pad 5 as an example of a second pad, a holder 6, a downstream fixing plate 66, an upstream fixing plate 67, a stay 68, urging members 69, a pair of side frames 7L, 7R, two bearings 11, 12, a pair of brackets 9L, 9R, and screws 14.

2.1 Heat Roller 2

As illustrated in FIG. 1, the heat roller 2 heats a sheet having a toner image thereon when the sheet passes through between the heat roller 2 and the belt 3. The heat roller 2 contacts a surface of the sheet on which the toner image has been transferred. The heat roller 2 extends in a first direction. The heat roller 2 is rotatable about a rotation axis extending in the first direction. The heat roller 2 is driven to rotate to convey a sheet. The heating unit 2 includes a roller body 20 and a heater 21. The roller body 20 is of cylindrical shape extending in the first direction. The heater 21 heats the roller body 20. The heater 21 is a halogen heater. The heater 21 is located in the roller body 20. The heater 21 extends in the first direction.

2.2 Belt 3

As illustrated in FIG. 2, the belt 3 faces the heat roller 2 in a second direction. The second direction is orthogonal to the first direction. The second direction is one of radial directions of the heat roller 2. The belt 3 contacts the heat roller 2. The second direction is orthogonal to a conveyance direction in a nip N where the heat roller 2 and the belt 3 contact each other. The second direction is a direction where the urging members 69 urge the stay 68 toward the heat roller 2. The conveyance direction in the nip N is a direction where a sheet passes through between the heat roller 2 and the belt 3 and is similar to a rotation direction of the heat roller 2 in the nip N. The nip N will be described later. The belt 3 extends in the first direction. The belt 3 is of cylindrical shape. The belt 3 is heat resistant and flexible. The belt 3 is made of polyimide resin.

2.3 Downstream Pad 4

As illustrated in FIG. 2, the downstream pad 4 presses a sheet having a toner image thereon when the sheet passes through between the heat roller 2 and the belt 3. The downstream pad 4 presses the belt 3 toward the heat roller 2. The downstream pad 4 is disposed within an interior space of the belt 3. The downstream pad 4 is disposed downstream of the upstream pad 5 in the conveyance direction in the nip N. The downstream pad 4 is harder than the upstream pad 5. The downstream pad 4 is an elastic member made of rubber. The downstream pad 4 extends in the first direction. The downstream pad 4 is of rectangular shape when viewed in the first direction. The downstream pad 4 has an upper front edge 40, an upper rear edge 41, a lower front edge 42, and a lower rear edge 43. The upper front edge 40 and the upper rear edge 41 are located to the heat roller 2 in the second direction. The lower front edge 42 and the lower rear edge 43 are located opposite to the heat roller 2 relative to the upper front edge 40 and the upper rear edge 41.

The upper front edge 40 and the upper rear edge 41 are spaced from each other in a third direction. The third direction is orthogonal to the first direction and the second direction. The third direction extends in the conveyance direction in the nip N. The third direction is a direction in the nip N directed from upstream toward downstream in the conveyance direction. The upper front edge 40 is located upstream of the upper rear edge 41 in the third direction. The upper front edge 40 brings the belt 3 into contact with the heat roller 2. More specifically, the upper front edge 40 brings the belt 3 into contact with the heat roller 2, forming a downstream nip N1. The upper rear edge 41 does not bring the belt 3 into contact with the heat roller 2. The upper front edge 40 contacts the belt 3. The upper front edge 40 and the heat roller 2 pinch a portion of the belt 3 therebetween. The upper rear edge 41 is spaced from the belt 3.

The lower front edge 42 and the lower rear edge 43 are spaced from each other in the third direction. The lower front edge 42 is located upstream of the lower rear edge 43 in the third direction.

The downstream pad 4 has an upstream end surface 44 and a downstream end surface 45 in the third direction. The upstream end surface 44 is located upstream of the downstream end surface 45 in the third direction. The upstream end surface 44 and the downstream end surface 45 are spaced from each other in the third direction. The upstream end surface 44 is located between the upper front edge 40 and the lower front edge 42. The downstream end surface 45 is located between the upper rear edge 41 and the lower rear edge 43.

2.4 Upstream Pad 5

As illustrated in FIG. 2, the upstream pad 5 presses a sheet having a toner image thereon when the sheet passes through between the heat roller 2 and the belt 3. The upstream pad 5 presses the belt 3 toward the heat roller 2. More specifically, at least a portion of the downstream pad 4 and at least a portion of the upstream pad 5 press the belt 3 toward the heat roller 2. The upstream pad 5 is disposed upstream of the downstream pad 4 in the third direction. The upstream pad 5 is softer than the downstream pad 4. The upstream pad 5 is an elastic member made of rubber. The upstream pad 5 extends in the first direction. The upstream pad 5 is of rectangular shape when viewed in the first direction.

The upstream pad 5 has an upstream portion 50 and a downstream portion 51. The upstream portion 50 is located upstream of the downstream portion 51 in the third direction. The upstream portion 50 does not bring the belt 3 into contact with the heat roller 2. The downstream portion 51 brings the belt 3 into contact with the heat roller 2. The upstream portion 50 is spaced from the belt 3. The downstream portion 51 contacts the belt 3. The downstream portion 51 and the heat roller 2 pinch a portion of the belt 3 therebetween.

The upstream pad 5 has an upper front edge 54, an upper rear edge 55, a lower front edge 56, and a lower rear edge 57. The upper front edge 54 and the upper rear edge 55 are located to the heat roller 2 in the second direction. The lower front edge 56 and the lower rear edge 57 are located opposite to the heat roller 2 relative to the upper front edge 54 and the upper rear edge 55.

The upper front edge 54 is located upstream of the upper rear edge 55 in the third direction. The lower rear edge 57 is located downstream of the lower front edge 56 in the third direction. The upper front edge 54 does not bring the belt 3 into contact with the heat roller 2. The upper rear edge 55 brings the belt 3 into contact with the heat roller 2. More specifically, the upper rear edge 55 brings the belt 3 into contact with the heat roller 2, forming an upstream nip N2. The upper front edge 54 is spaced from the belt 3. The upper rear edge 55 contacts the belt 3. The upper rear edge 55 and the heat roller 2 pinch a portion of the belt 3 therebetween.

In other words, the upper front edge 40 of the downstream pad 4 and the upper rear edge 55 of the upstream pad 5 press the belt 3 toward the heat roller 2. The belt 3 thus contacts the heat roller 2 in a range from a portion of the belt 3 pinched between the upper rear edge 55 and the heat roller 2 and a portion of the belt 3 pinched between the upper front edge 40 and the heat roller 2, thus forming the nip N. In other words, the nip N ranges in the third direction from an upstream end of the upstream nip N2 to a downstream end of the downstream nip N1. The nip N is where the heat roller 2 and the belt 3 contact each other.

The upstream pad 5 has an upstream end surface 52 and a downstream end surface 53 in the third direction. The upstream end surface 52 is located upstream of the downstream end surface 53 in the third direction. The upstream end surface 52 and the downstream end surface 53 are spaced from each other in the third direction. The upstream portion 50 includes the upstream end surface 52. The upstream end surface 52 is located between the upper front edge 54 and the lower front edge 56. The downstream portion 51 includes the downstream end surface 53. The downstream end surface 53 is located between the upper rear edge 55 and the lower rear edge 57.

2.5 Holder 6

As illustrated in FIGS. 2 and 3, the holder 6 holds the downstream pad 4 via the downstream fixing plate 66. The holder 6 holds the upstream pad 5 via the upstream fixing plate 67. The holder 6 includes a holder body 60 and holder protrusions 61, 62.

As illustrated in FIG. 2, the holder body 60 supports the downstream pad 4 and the upstream pad 5. The holder body 60 is disposed within the interior space of the belt 3. The holder body 60 extends in the first direction. The holder body 60 includes a first recess 63 and a second recess 64. The first recess 63 is located downstream of the second recess 64 in the third direction.

The first recess 63 receives therein the downstream pad 4 and the downstream fixing plate 66. The first recess 63 is recessed away from the heat roller 2 in the second direction. The first recess 63 extends in the first direction. The first recess 63 includes a restriction surface 63A and an inner side surface 63B. In other words, the holder 6 includes the restriction surface 63A. The restriction surface 63A restricts movement of the downstream pad 4 in the third direction. The restriction surface 63A contacts the downstream end surface 45 of the downstream pad 4 in the third direction to restrict the downstream movement of the downstream pad 4 in the third direction. In other words, the restriction surface 63A contacts the downstream end surface 45 from a downstream side in the third direction. The restriction surface 63A is located opposite to the second recess 64 relative to the downstream pad 4. The inner side surface 63B is located between the downstream pad 4 and the second recess 64 in the third direction.

The second recess 64 receives therein the upstream pad 5 and the upstream fixing plate 67. The second recess 64 is recessed away from the heat roller 2 in the second direction. The second recess 64 extends in the first direction. The second recess 64 includes a restriction surface 64A and an inner side surface 64B. The restriction surface 64A restricts movement of the upstream pad 5 in the third direction. The restriction surface 64A contacts the upstream end surface 52 of the upstream pad 5 in the third direction to restrict the upstream movement of the upstream pad 5 in the third direction. In other words, the restriction surface 64A contacts the upstream end surface 52 from an upstream side in the third direction. The restriction surface 64A is located opposite to the first recess 63 relative to the upstream pad 5. The inner side surface 64B is located between the upstream pad 5 and the first recess 63 in the third direction.

As illustrated in FIG. 3, the holder protrusions 61, 62 sandwich therebetween the holder body 60 in the first direction. The holder body 60 includes a first end portion 60A and a second end portion 60B opposite to the first end portion 60A in the first direction. The holder protrusion 61 protrudes from the first end portion 60A of the holder body 60 in the first direction. The holder protrusion 62 protrudes from the second end portion 60B of the holder body 60 in the first direction. The holder protrusions 61, 62 are of square tubular shape.

2.6 Downstream Fixing Plate 66

As illustrated in FIG. 2, the downstream fixing plate 66 is disposed in the first recess 63. The downstream fixing plate 66 extends in the first direction. The downstream fixing plate 66 may be made of a material harder than that of the downstream pad 4, for example, metal or resin. The downstream fixing plate 66 contacts a bottom surface of the first recess 63. The downstream fixing plate 66 is located upstream relative to the downstream pad 4 in the second direction. The downstream pad 4 is fixedly bonded to the downstream fixing plate 66. The downstream fixing plate 66 is located upstream relative to the downstream end surface 45 of the downstream pad 4 in the third direction. The downstream fixing plate 66 includes a downstream end 661 and an upstream end 662 located upstream relative to the downstream end 661 in the third direction. The downstream end 661 faces and is spaced from the restriction surface 63A in the third direction. The downstream end 661 is located opposite to the restriction surface 63A relative to the downstream end surface 45 in the third direction. The upstream end 662 faces the inner side surface 63B in the third direction.

2.7 Upstream Fixing Plate 67

The upstream fixing plate 67 is disposed in the second recess 64. The upstream fixing plate 67 extends in the first direction. The upstream fixing plate 67 may be made of the same material as that of the downstream fixing plate 66. The upstream fixing plate 67 contacts a bottom surface of the second recess 64. The upstream fixing plate 67 is located upstream relative to the upstream pad 5 in the second direction. The upstream pad 5 is fixedly bonded to the upstream fixing plate 67. The upstream fixing plate 67 is located downstream relative to the upstream end surface 52 of the downstream pad 5 in the third direction. The upstream fixing plate 67 includes a downstream end 671 and an upstream end 672 located upstream relative to the downstream end 671 in the third direction. The downstream end 671 faces the inner side surface 64B in the third direction. The upstream end 672 faces and is spaced from the restriction surface 64A in the third direction. The upstream end 672 is located opposite to the restriction surface 64A relative to the upstream end surface 52 in the third direction.

2.8 Stay 68

As illustrated in FIG. 2, the stay 68 supports the holder 6. The stay 68 is located opposite to the heat roller 2 relative to the holder 6 in the second direction. The stay 68 contacts the holder 6. The stay 68 extends in the second direction. The stay 68 includes a first end surface 68A and a second end surface 68B opposite to the first end surface 68A in the second direction. The first end surface 68A extends in the first direction and the third direction. The first end surface 68A contacts the holder 6. A contact area A between the stay 68 and the holder 6 is located downstream of a center B of the nip N and upstream of a center C of the downstream pad 4 in the third direction. The contact area A is located between the center B of the nip N and the center C of the downstream pad 4 in the third direction. The contact area A is located closer to the downstream pad 4 than to the upstream pad 5 in the third direction. The stay 68 is disposed at a position different from the downstream pad 4 in the third direction. The contact area A is located upstream relative to the upper front edge 40 in the third direction. The contact area A is located upstream relative to and away from the upstream end surface 44 in the third direction. The contact area A is located downstream relative to and away from the center B of the nip N in the third direction.

As illustrated in FIG. 3, the stay 68 is urged toward the heat roller 2 by the urging members 69. The downstream pad 4 and the upstream pad 5 thus press the belt 3 toward the heat roller 2. The stay 68 may be made of metal. The stay 68 includes a stay body 681 and insertion portions 682, 683. The stay body 681 is located opposite to the heat roller 2 relative to the holder body 60 in the second direction. The stay body 681 contacts the holder body 60. The stay body 681 is located toward the downstream pad 4 relative to a midpoint between the downstream pad 4 and the upstream pad 5 in the third direction (FIG. 2). The stay body 681 extends in the first direction. The insertion portion 682 protrudes from a first end of the stay body 681 in the first direction. The insertion portion 683 protrudes from a second end of the stay body 681 opposite to the first end in the first direction. The insertion portion 682 is inserted into the holder protrusion 61. The insertion portion 683 is inserted into the holder protrusion 62.

2.9 Urging Members 69

The two urging members 69 apply pressure to the stay 68. The urging members 69 are spaced from each other in the first direction. Each urging member 69 includes a spring 691 and a contact portion 692. In other words, the fixing device 1 includes two springs 691. The springs 691 urge the downstream pad 4 and the upstream pad 5 toward the heat roller 2 via the stay 68. The springs 691 are helical compression springs each including a plurality of turns of wire. Each contact portion 692 is located at a downstream end of the corresponding urging member 69 in the second direction. Each contact portion 692 contacts a corresponding one of the holder protrusions 61, 62 from opposite the heat roller 2 in the second direction. Each urging member 69 has an upstream end in the second direction supported by a corresponding one of the side frames 7L, 7R. The urging members 69 thus press the stay 68 toward the heat roller 2 via the stay 68.

2.10 Side Frames 7L, 7R and Bearings 11, 12

As illustrated in FIG. 3, the side frames 7L, 7R support the heat roller 2. The side frame 7L is spaced from the side frame 7R in the first direction. The side frame 7L and the side frame 7R are identical in structure. Hereinafter, the side frame 7R will be mainly described and the side frame 7L will be simply described and illustrated or omitted.

Figure 4:
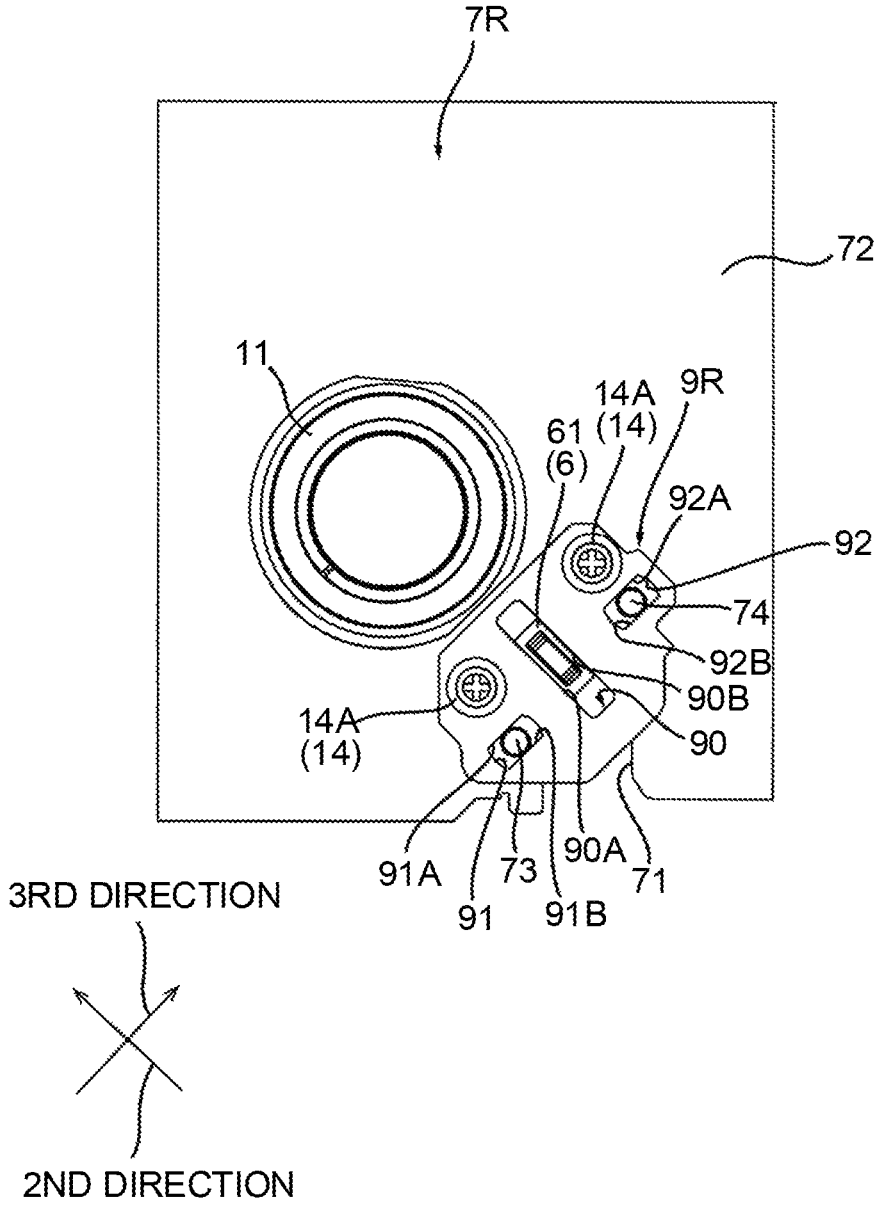
FIG. 4 is a side sectional view of the fixing device illustrated in FIG. 1.
Figure 6:
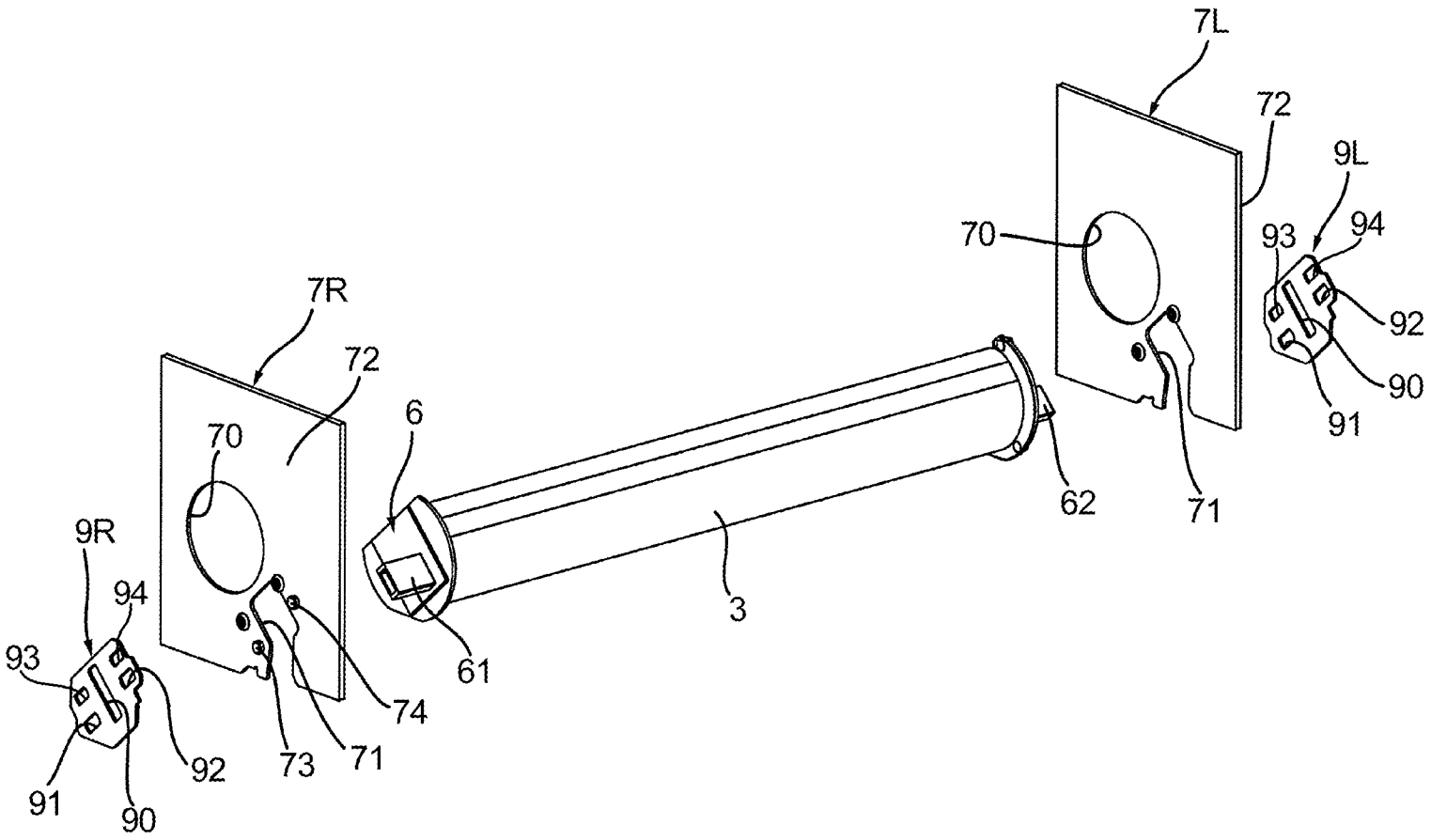
FIG. 6 is an exploded perspective view of the holder of the fixing device illustrated in FIG. 2 to be attached to side frames.

The side frame 7R has a plate shape. The side frame 7R extends orthogonally to the first direction. The side frame 7R includes a flat surface 72. The flat surface 72 faces away from a surface of the side frame 7R facing the side frame 7L. The flat surface 72 extends orthogonally to the first direction. As illustrated in FIGS. 4 and 6, the side frame 7R includes a first support portion 70, an opening 71, a first protrusion 73, and a second protrusion 74. The side frame 7R further includes a pair of screw holes. The screws 14A are screwed into the respective screw holes. The opening 71 is located between the screw holes in the third direction.

The first support portion 70 supports an end portion of the heat roller 2 in the first direction. The first support portion 70 positions the heat roller 2 relative to the side frame 7R in a radial direction of the heat roller 2. The heat roller 2 has a first end portion 2A and a second end portion 2B opposite to the first end portion 2A in the first direction. The first support portion 70 in the side frame 7R supports the first end portion 2A. The first support portion 70 in the side frame 7L supports the second end portion 2B.

The first support portion 70 is a hole. The first support portion 70 is circular when viewed in the first direction. The first end portion 2A is inserted into the first support portion 70 in the side frame 7R. The second end portion 2B is inserted into the first support portion 70 in the side frame 7L. The heat roller 2 thus passes through the side frames 7R, 7L in the first direction. The first end portion 2A has a peripheral surface rotatably supported by the bearing 11. The second end portion 2B has a peripheral surface rotatably supported by the bearing 12. In other words, the bearing 11 rotatably supports the peripheral surface of the first end portion 2A. The bearing 12 rotatably supports the peripheral surface of the second end portion 2B. The first support portion 70 in the side frame 7R supports the first end portion 2A via the bearing 11. The first support portion 70 in the side frame 7L supports the second end portion 2B via the bearing 12.

The opening 71 is spaced from the first support portion 70 in the second direction. The opening 71 in the side frame 7R allows insertion of the holder protrusion 61. The holder protrusion 61 passes through the side frame 7R in the first direction. The opening 71 in the side frame 7L allows insertion of the holder protrusion 62. The holder protrusion 62 passes through the side frame 7L in the first direction. In the second direction, the opening 71 has a greater dimension than the holder protrusion 61, 62. In the third direction, the opening 71 has a greater dimension than the holder protrusion 61, 62.

As illustrated in FIG. 4, the first protrusion 73 and the second protrusion 74 protrude from the flat surface 72 in the first direction. The first protrusion 73 and the second protrusion 74 are of cylindrical shape. The first protrusion 73 is located upstream of the holder protrusion 61 in the third direction. The second protrusion 74 is located downstream of the holder protrusion 61 in the third direction. The opening 71 is located between the first protrusion 73 and the second protrusion 74 in the third direction.

2.11 Brackets 9L, 9R

As illustrated in FIGS. 3 and 4, the brackets 9L, 9R support the holder 6. The bracket 9R is located opposite to the side frame 7L relative to the side frame 7R in the first direction. The bracket 9R contacts the flat surface 72 of the side frame 7R in the first direction. The bracket 9L is located opposite to the side frame 7R relative to the side frame 7L in the first direction. The bracket 9L contacts the flat surface 72 of the side frame 7L in the first direction. The bracket 9L and the bracket 9R are identical in structure. Hereinafter, the bracket 9R will be mainly described and the bracket 9L will be simply described and illustrated or omitted.

The bracket 9R is movable relative to the side frame 7R in the third direction. More specifically, the bracket 9R is movable in the third direction before it is secured to the side frame 7R using the two screws 14. The bracket 9R has a plate shape. The bracket 9R extends orthogonally to the first direction. As illustrated in FIGS. 4 and 6, the bracket 9R includes a second support portion 90, a first contact portion 91, and a second contact portion 92. The bracket 9R further includes a pair of long holes 93, 94. The screws 14A are inserted into the respective long holes 93, 94. The long holes 93, 94 are long in the third direction. The second support portion 90 is located between the long holes 93, 94 in the third direction.

The second support portion 90 supports the holder 6 movably in the second direction. The second support portion 90 is a long hole that is long in the second direction. As illustrated in FIG. 6, the second support portion 90 communicates with the opening 71 in the first direction. The holder protrusion 61 is inserted into the second support portion 90 of the bracket 9R. The holder protrusion 62 is inserted into the second support portion 90 of the bracket 9L. In the second direction, the second support portion 90 has a greater dimension than the holder protrusion 61, 62.

As illustrated in FIG. 4, the second support portion 90 has contact surfaces 90A, 90B. The contact surfaces 90A, 90B of the bracket 9R are contactable with the holder protrusion 61. The contact surfaces 90A, 90B of the bracket 9L are contactable with the holder protrusion 62. The contact surfaces 90A, 90B face and are spaced from each other in the third direction. The contact surfaces 90A, 90B extend in the second direction.

The first contact portion 91 contacts the first protrusion 73 in the second direction. The second contact portion 92 contacts the second protrusion 74 in the second direction. The first contact portion 91 is located upstream of the second support portion 90 in the third direction. The second contact portion 92 is located downstream of the second support portion 90 in the third direction. The second support portion 90 is located between the first contact portion 91 and the second contact portion 92 in the third direction.

The first contact portion 91 is a long hole that is long in the third direction. The first protrusion 73 is inserted into the first contact portion 91. The first contact portion 91 has two first guide surfaces 91A, 91B. The first guide surface 91A is spaced from the first guide surface 91B in the second direction. The first guide surfaces 91A, 91B are contactable with the first protrusion 73 to guide the first protrusion 73. The first guide surfaces 91A, 91B extend in the third direction.

The second contact portion 92 is a long hole that is long in the third direction. The second protrusion 74 is inserted into the second contact portion 92. The second contact portion 92 has two second guide surfaces 92A, 92B. The second guide surface 92A is spaced from the second guide surface 92B in the second direction. The second guide surfaces 92A, 92B are contactable with the second protrusion 74 to guide the second protrusion 74. The second guide surfaces 92A, 92B extend in the third direction.

The brackets 9R is thus movable in the third direction with the first protrusion 73 contacting the first contact portion 91. Similarly, the brackets 9L is movable in the third direction with the second protrusion 74 contacting the second contact portion 92.

2.12 Screws 14

As illustrated in FIGS. 3 and 4, the bracket 9R is secured to the side frame 7R with two first screws 14A. The bracket 9L is secured to the side frame 7L with two second screws 14B. One of the first screws 14A is screwed into a screw hole in the side frame 7R via the long hole 93 in the bracket 9R. The other one of the first screws 14A is screwed into another screw hole in the side frame 7R via the long hole 94 in the bracket 9R. One of the second screws 14B is screwed into a screw hole in the side frame 7L via the long hole 93 in the bracket 9L. The other one of the second screws 14B is screwed into another screw hole in the side frame 7L via the long hole 94 in the bracket 9L.

3. Process of Manufacturing Fixing Device 1

Referring to FIGS. 5A to 7, a process of manufacturing the fixing device 1 will be described.

Figure 5A:
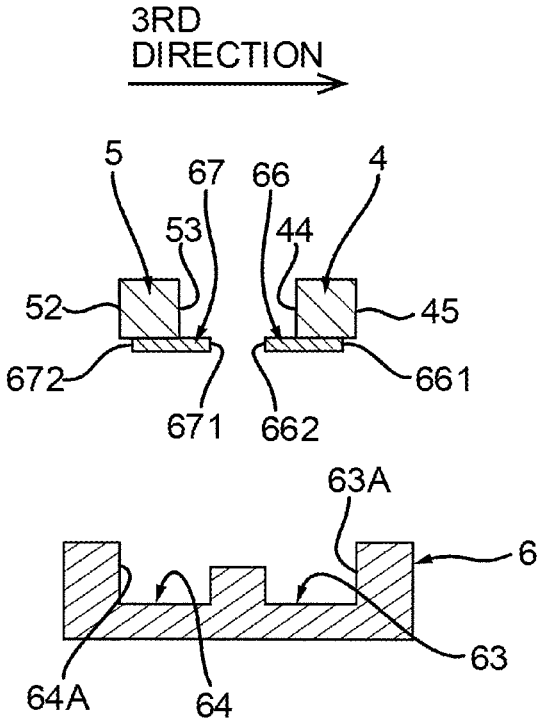
FIG. 5A illustrates a process of manufacturing the fixing device illustrated in FIG. 2, wherein upstream and downstream pads are to be attached to a holder.

As illustrated in FIG. 5A, to manufacture the fixing device 1, the downstream pad 4 is bonded to the downstream fixing plate 66. At that time, the downstream end surface 45 of the downstream pad 4 is located downstream of the downstream end 661 of the downstream fixing plate 66 in the third direction. The upstream end surface 44 of the downstream pad 4 is located between the downstream end 661 and the upstream end 662 of the downstream fixing plate 66 in the third direction.

The upstream pad 5 is bonded to the upstream fixing plate 67. At that time, the upstream end surface 52 of the upstream pad 5 is located upstream of the upstream end 672 of the upstream fixing plate 67 in the third direction. The downstream end surface 53 of the downstream pad 5 is located between a downstream end 671 and the upstream end 672 of the upstream fixing plate 67 in the third direction.

The downstream pad 4 and the downstream fixing plate 66 are placed in the first recess 63. At that time, the downstream end 661 of the downstream fixing plate 66 does not contact the restriction surface 63A, while the downstream end surface 45 of the downstream pad 4 contacts the restriction surface 63A.

The upstream pad 5 and the upstream fixing plate 67 are placed in the second recess 64. At that time, the upstream end 672 of the upstream fixing plate 67 does not contact the restriction surface 64A, while the upstream end surface 52 of the upstream pad 5 contacts the restriction surface 64A.

The insertion portions 682, 683 of the stay 68 are inserted into the holder protrusions 61, 62, respectively. The stay 68 is thus positioned to the holder 6. The stay may be attached to the holder before the pads are attached to the holder.

Figure 5B:
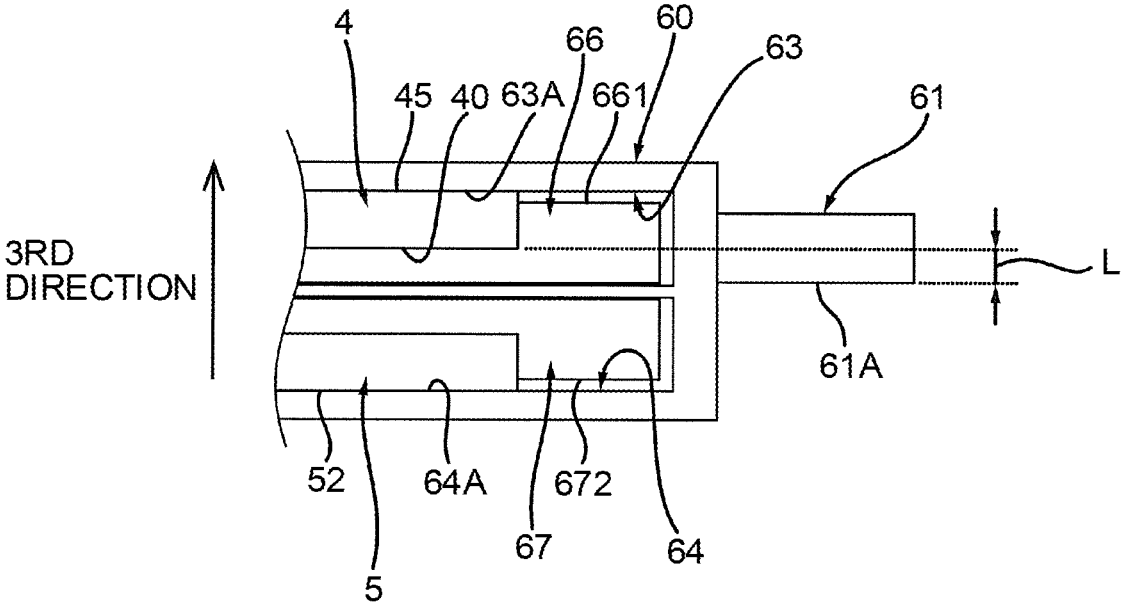
FIG. 5B illustrates process of measuring a dimension between an upper front edge of the downstream pad illustrated in FIG. 5A and a reference surface of a holder protrusion.

As illustrated in FIG. 5B, a measurement is made to obtain a dimension L between the upper front edge 40 and a reference surface 61A of the holder protrusion 61. The reference surface 61A is, for example, an end surface of the holder protrusion 61 in the third direction and a flat surface orthogonal to the third direction. Thereafter, the holder body 60 is inserted into the interior space of the belt 3.

As illustrated in FIG. 6, the belt 3 is sandwiched between the side frame 7R and the side frame 7L. At that time, the holder protrusion 61 is inserted into the opening 71 in the side frame 7R. The holder protrusion 62 is inserted into the opening 71 in the side frame 7L.

The bracket 9R is placed on the flat surface 72 of the side frame 7R. The bracket 9L is placed on the flat surface 72 of the side frame 7L. At that time, the second support portion 90 in the bracket 9R receives the holder protrusion 61. The second support portion 90 in the bracket 9L receives the holder protrusion 62. The first contact portion 91 receives the first protrusion 73. The second contact portion 92 receives the second protrusion 74.

Figure 7:
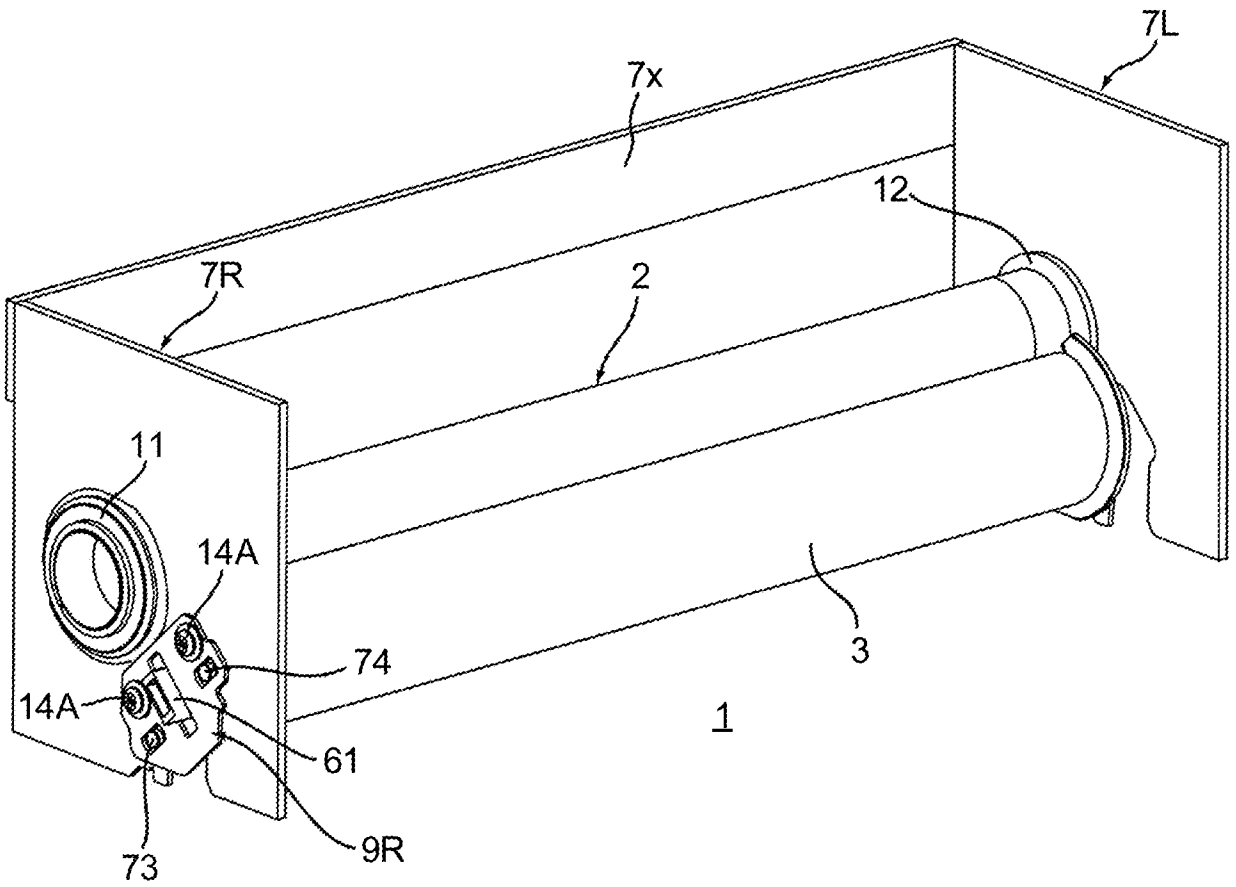
FIG. 7 is a perspective view of the fixing device illustrated in FIG. 2.

As illustrated in FIG. 7, the heat roller 2 has one end attached to the side frame 7R via the bearing 11 and the other end attached to the side frame 7L via the bearing 12. The side frame 7R and the side frame 7L are connected to each other with a connecting plate 7*x*. The fixing device 1 includes the connecting plate 7*x* connecting the side frames 7L, 7R. The brackets 9R, 9L are slid in the third direction based on the dimension L and the downstream pad 4 is thus positioned to a predetermined position.

The bracket 9R is secured to the side frame 7R with the first screws 14A. The bracket 9L is secured to the side frame 7L with the second screws 14B. The fixing device 1 is manufactured in this manner.

4. Operational Effects of First Embodiment

As illustrated in FIG. 2, the contact area A between the stay 68 and the holder 6 is located downstream of the center B of the nip N in the third direction. Thus, the urging forces of the springs 691 efficiently act on the downstream pad 4 more than on the upstream pad 5 located upstream of the downstream pad 4 in the third direction. The contact area A between the stay 68 and the holder 6 is located upstream of the center C of the downstream pad 4 in the third direction. This prevents the holder 6 from rotating such that the upstream pad 5 is separated from the heat roller 2.

Consequently, the pressure can be set greater in the downstream nip N1 formed by the downstream pad 4 than in the upstream nip N2 formed by the upstream pad 5. The holder 6 is resistant to rotation, unlike a structure where the contact area A is located at a position overlapping the center C in the third direction. This structure thus prevents the pressure distribution in the nip N in the third direction from becoming unstable.

The upstream pad 5 is spaced from the downstream pad 4. This enables widening of the nip N where the heat roller 2 and the belt 3 contact each other. The contact area A between the stay 68 and the holder 6 is located closer to the downstream pad 4 than to the upstream pad 5. In the wide nip N, the urging forces from the springs 691 can be exerted on the downstream pad 4. Consequently, a required pressure distribution can be formed in the wide nip N.

The stay 68 is disposed at a position different from the downstream pad 4 in the third direction. The stay 68 is disposed downstream of the center B of the nip N and upstream of the downstream pad 4 in the third direction. This reliably prevents the holder 6 from rotating such that the upstream pad 5 is separated from the heat roller 2. Consequently, the pressure distribution in the nip N in the third direction can be prevented from becoming unstable.

The stay 68 is disposed at a position not overlapping the downstream pad 4 in the third direction. The stay 68 is thus insusceptible to heat from the heater 21, unlike, for example, a stay disposed at a position overlapping the downstream pad 4 in the third direction. This reduces the stay 68 from deforming with heat and thus improves the stability of the pressure distribution in the nip N in the third direction.

In the downstream pad 4, the upper front edge 40 brings the belt 3 into contact with the heat roller 2, while the upper rear edge 41 does not bring the belt 3 into contact with the heat roller 2. In the image fixing operation, the downstream pad 4 can impart an appropriate pressure to a sheet. The pressure distribution in the nip N in the third direction can be appropriately adjusted.

The contact area A between the stay 68 and the holder 6 is located upstream of the upper front edge 40 in the third direction. The contact area A is located downstream of the center B of the nip N and upstream of the upper front edge 40 in the third direction. This reliably prevents the holder 6 from rotating such that the upstream pad 5 is separated from the heat roller 2.

The contact area A is located upstream of the upper front edge 40 in the third direction. This reduces the heat transfer from the heater 21, via the downstream pad 4 and the holder 6, to the stay 68 and thus reduces the stay 68 from deforming with heat. This improves the stability of the pressure distribution in the nip N in the third direction.

In the upstream pad 5, the upper rear edge 55 brings the belt 3 into contact with the heat roller 2, while the upper front edge 54 does not bring the belt 3 into contact with the heat roller 2. The pressure distribution in the nip N in the third direction can be appropriately adjusted.

As illustrated in FIG. 4, the side frame 7R that supports the heat roller 2 includes the first protrusion 73 and the bracket 9R includes the first contact portion 91. The first contact portion 91 contacts the first protrusion 73 in the second direction. The bracket 9R is movable in the third direction with the first protrusion 73 contacting the first contact portion 91.

When the downstream pad 4 attached to the holder 6 deviates from its expected position, the bracket 9R can be moved in the third direction to adjust the position of the downstream pad 4 relative to the heat roller 2 in the third direction. This improves the positioning accuracy of the downstream pad 4 relative to the heat roller 2.

As illustrated in FIG. 3, the first support portion 70 in the side frame 7R positions the heat roller 2 relative to the side frame 7R in a radial direction of the heat roller 2. The bracket 9R can be moved in the third direction to adjust the position of the downstream pad 4 relative to the heat roller 2 in the third direction.

The first support portion 70 in the side frame 7R supports the bearing 11 and positions the heat roller 2 in the radial direction. The side frame 7R can thus receive a load applied, in the second direction, to the heat roller 2 via the bearing 11. This stabilizes the position of the heat roller 2 relative to the side frame 7R and the position of the downstream pad 4 relative to the heat roller 2 in the second direction.

As illustrated in FIG. 4, the bracket 9R includes the second support portion 90. The second support portion 90 supports the holder 6 movably in the second direction. The pressure of the downstream pad 4 to be applied to the heat roller 2 is adjusted by moving the holder 6.

The contact surface 90A contacts the holder protrusion 61 in the third direction. The second support portion 90 can thus receive a load applied, in the third direction, to the holder 6. This stabilizes the position of the downstream pad 4 relative to the heat roller 2 in the third direction.

After the position of the downstream pad 4 is adjusted relative to the heat roller 2 in the third direction, the first screws 14A are tightened so that the bracket 9R is secured to the side frame 7R.

The first protrusion 73 contacts the first contact portion 91 upstream relative to the holder 6 in the third direction, and the second protrusion 74 contacts the second contact portion 92 downstream relative to the holder 6 in the third direction. This structure allows the bracket 9R to slide relative to the side frame 7R in the third direction and thus improves the positioning accuracy of the downstream pad 4 relative to the heat roller 2 in the third direction.

The restriction surface 63A contacts the downstream pad 4 in the third direction. This improves the positioning accuracy of the downstream pad 4 relative to the holder 6 in the third direction.

The stay body 681 is located toward the downstream pad 4 relative to a midpoint between the downstream pad 4 and the upstream pad 5 in the third direction. The downstream pad 4 thus receives greater loads from the urging members 69 via the stay 68 than the upstream pad 5. The bracket 9R can be moved in the third direction to adjust the position of the downstream pad 4, which receives relatively great loads, relative to the heat roller 2 in the third direction.

5. Variations of First Embodiment

Figure 8:
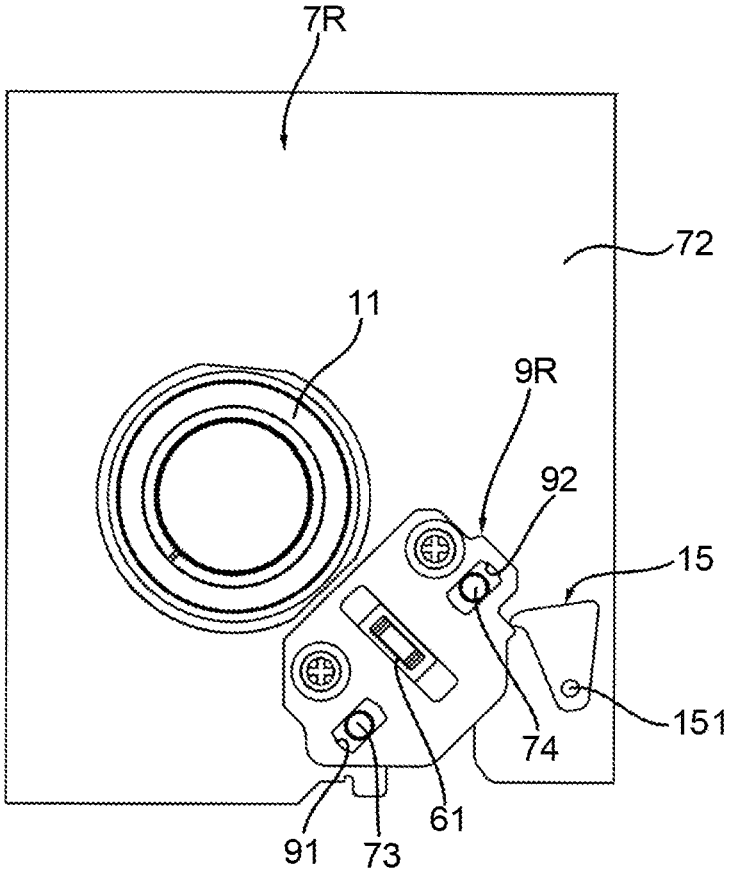
FIG. 8 is a side sectional view of a fixing device according to a first variation of the first embodiment.

Referring to FIG. 8, a first variation of the first embodiment will be described. In the following description, elements similar to or identical with those illustrated in the above embodiment are designated by similar numerals, and thus the description thereof can be omitted for the sake of brevity.

As illustrated in FIG. 8, a fixing device according to the first variation includes a contact member 15. The contact member 15 is attached to the side frame 7R. The contact member 15 is disposed on the flat surface 72 of the side frame 7R. The contact member 15 contacts the bracket 9R in the third direction. The contact member 15 includes a shaft 151. The shaft 151 extends in the first direction. The shaft 151 is fixed to the side frame 7R. The contact member 15 is pivotable about the shaft 151 to be fixedly positioned relative to the bracket 9R.

According to the first variation, the contact member 15 contacts the bracket 9R in the third direction. This improves the positioning accuracy of the bracket 9R relative to the side frame 7R in the third direction. The first variation may achieve the same operational effects as the first embodiment described above.

Figure 9:
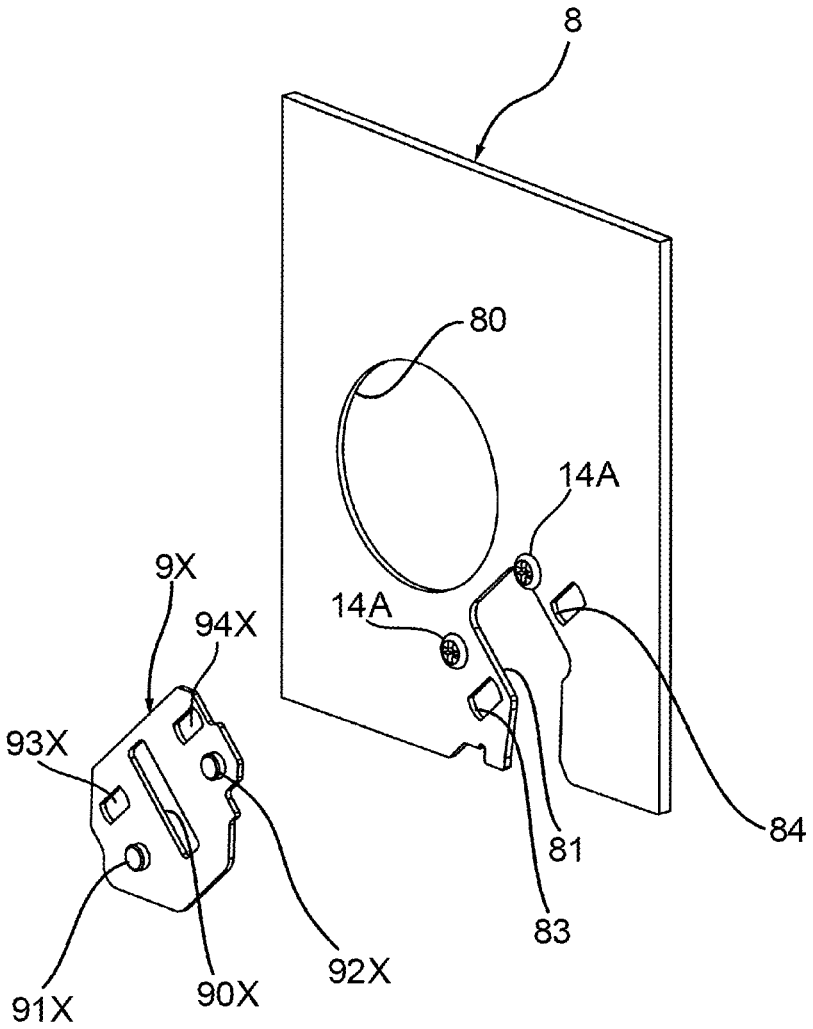
FIG. 9 is a perspective view of a side frame and a bracket in a fixing device according to a second variation of the first embodiment.

Referring to FIG. 9, a second variation of the first embodiment will be described. In the following description, elements similar to or identical with those illustrated in the above embodiment are designated by similar numerals, and thus the description thereof can be omitted for the sake of brevity.

A fixing device according to the second variation includes a pair of side frames 8R, 8L and a pair of brackets 9X. As illustrated in FIG. 9, a side frame 8R includes a support portion 80, an opening 81, a first contact portion 83, and a second contact portion 84. The support portion 80 and the opening 81 are identical in shape and function to the first support portion 70 and the opening 71, respectively, which are described in the first embodiment. The bracket 9X includes a second support portion 90X, a pin 91X, a pin 92X, a long hole 93X, and a long hole 94X. The second support portion 90X is identical in shape and function to the second support portion 90 described in the first embodiment. The long hole 93X and the long hole 94X are identical in shape and function to the long hole 93 and the long hole 94, respectively, which are described in the first embodiment. The pins 91X, 92X, which are press fitted into the holes in the bracket 9X, are formed in one piece with the bracket 9X. The pins 91X, 92X are of cylindrical shape extending in the first direction and protrude toward the side frame 8R. The pin 91X is located upstream of the second support portion 90X in the third direction. The pin 92X is located downstream of the second support portion 90X in the third direction.

The first contact portion 83 is located upstream of the opening 81 in the third direction. The second contact portion 84 is located downstream of the opening 81 in the third direction. The first contact portion 83 is a long hole that is long in the third direction and into which the pin 91X is inserted. In the second direction, a width of the first contact portion 83 is nearly equal to the outside diameter of the pin 91X. In the third direction, a width of the first contact portion 83 is greater than the outside diameter of the pin 91X. The pin 91X inserted into the first contact portion 83 is thus movable in the third direction. The second contact portion 84 and the pin 92X may be taken as having similar relationship to the first contact portion 83 and the pin 91X, and thus will be simply illustrated.

The second variation may achieve the same operational effects as the first embodiment described above.

6. Second Embodiment

Referring to FIGS. 10 to 15, a second embodiment of the disclosure will be described. In the following description, elements similar to or identical with those illustrated in the above embodiment are designated by similar numerals, and thus the description thereof can be omitted for the sake of brevity.

A fixing device 200 according to the second embodiment includes a heat roller 2 as an example of a roller, a belt 3, a downstream pad 4, an upstream pad 205, a holder 206, a sliding sheet 207, a stay 201, a sub-stay 202, a pair of urging members 212, a plurality of connectors 208, a plurality of first screws 209, an upstream guide 203, a plurality of second screws 210, a downstream guide 204, and a plurality of third screws 211.

6.1 Upstream Pad 205

The upstream pad 205 is identical in structure to the upstream pad 5 described in the first embodiment, except for dimensions in the second direction and the third direction. Hereinafter, the upstream pad 205 will be simply described and illustrated. In the second direction, the upstream pad 205 has a greater dimension than the downstream pad 4 and the upstream pad 5. In the third direction, the upstream pad 205 has a greater dimension than the downstream pad 4 and the upstream pad 5.

6.2 Holder 206

The holder 206 holds the downstream pad 4 and the upstream pad 205. The holder 206 is identical in structure to the holder body 60 described in the first embodiment, except for a dimension of the second recess 64 in the third direction. Hereinafter, the holder 206 will be simply described and illustrated. In the third direction, the second recess 64 of the holder 206 has a greater dimension than the second recess 64 of the holder body 60. In the third direction, the second recess 64 has a greater dimension than the first recess 63.

6.3 Sliding Sheet 207

The sliding sheet 207 is used to facilitate the smooth sliding of the belt 3 on the downstream pad 4 and the upstream pad 205. The sliding sheet 207 extends through between the belt 3, the downstream pad 4, and the upstream pad 205. The sliding sheet 207 is pinched in the nip N between an inner peripheral surface of the belt 3 and the downstream pad 4 and between the inner peripheral surface of the belt 3 and the upstream pad 205. The sliding sheet 207 has a first end and a second end apart from the first end. The first end of the sliding sheet 207 is fixed to the upstream guide 203. The second end of the sliding sheet 207 is not fixed to any members. The second end of the sliding sheet 207 may be fixed to the downstream guide 204.

6.4 Stay 201

The stay 201 supports the holder 206. The stay 201 is located opposite to the heat roller 2 relative to the holder 206 in the second direction. The stay 201 contacts the holder 206. The stay 201 may be made of a sheet of metal and is bent by hemming. The stay 201 has a first end surface 201A and a second end surface 201B apart from the first end surface 201A. The first end surface 201A and the second end surface 201B extend in the third direction. The first end surface 201A contacts the holder 206.

Figure 11:
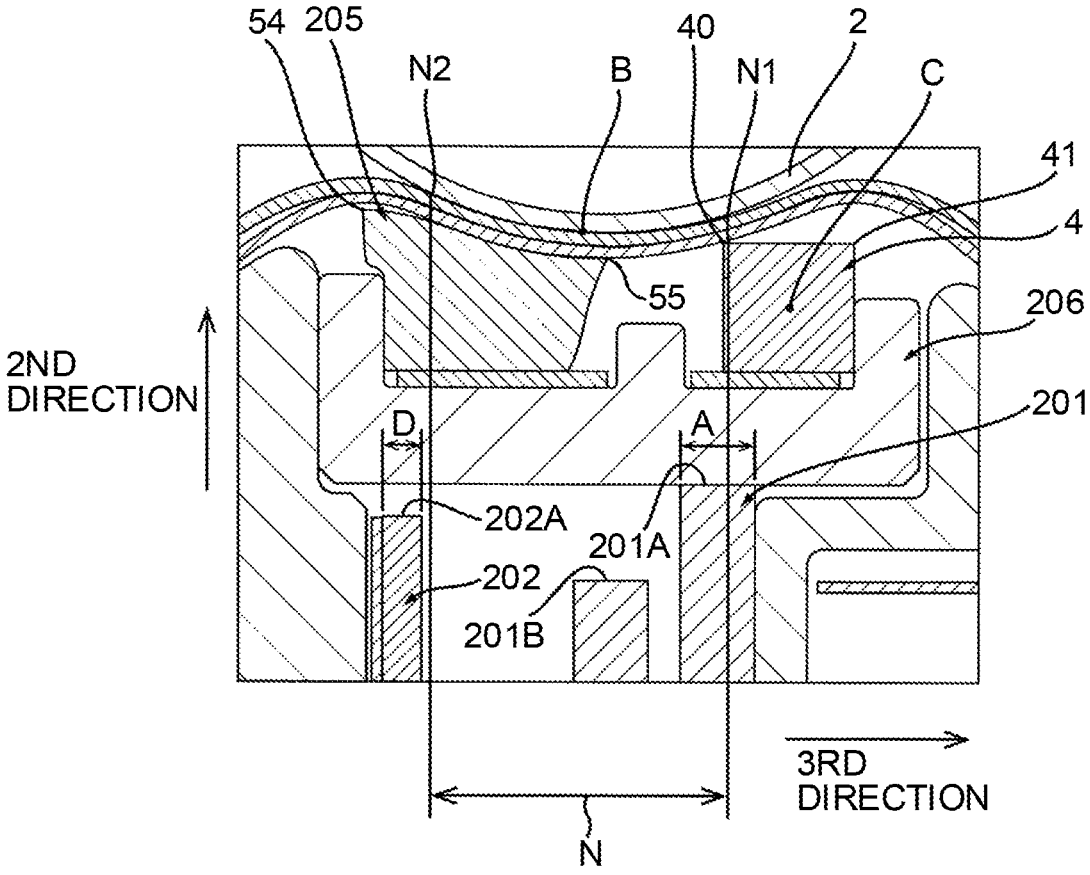
FIG. 11 is an enlarged cross sectional view of a downstream pad and an upstream pad in the fixing device illustrated in FIG. 10.

As illustrated in FIG. 11, a contact area A between the first end surface 201A of the stay 201 and the holder 206 is located downstream of a center B of the nip N and upstream of a center C of the downstream pad 4 in the third direction.

The contact area A is located between the center B of the nip N and the center C of the downstream pad 4 in the third direction. The contact area A is located closer to the downstream pad 4 than to the upstream pad 205 in the third direction. The stay 201 is disposed at a position overlapping the downstream pad 4 in the third direction. When projected in the second direction, the contact area A overlaps the upper front edge 40. The second end surface 201B is located upstream of the first end surface 201A in the third direction. The second end surface 201B does not contact the holder 206. The second end surface 201B is spaced from the holder 206 in the second direction. The second end surface 201B is located upstream of the first end surface 201A in the second direction.

6.5 Sub-Stay 202

Figure 10:
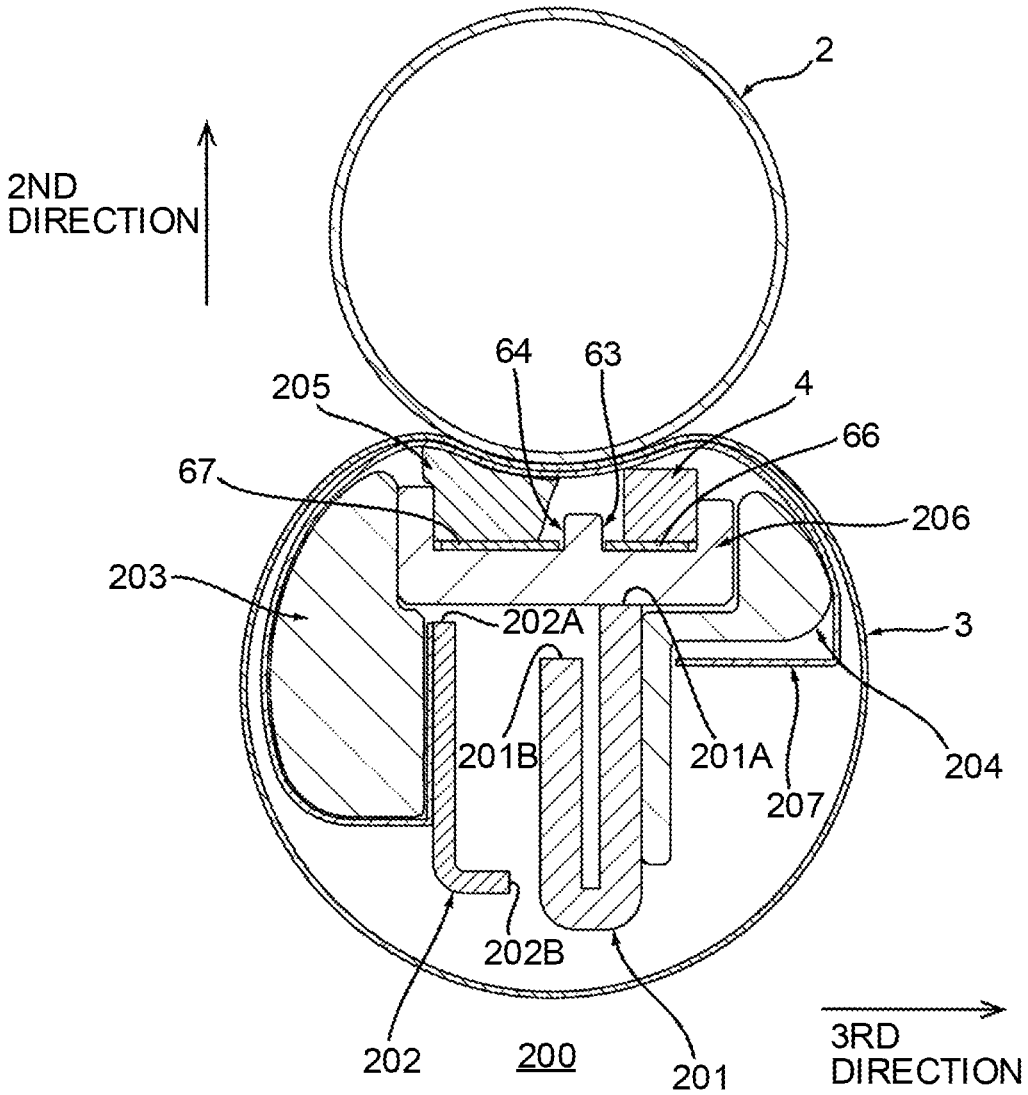
FIG. 10 is a cross sectional view of a fixing device according to a second embodiment of the disclosure.

The sub-stay 202 is located opposite to the heat roller 2 relative to the holder 206 in the second direction. The sub-stay 202 is located upstream of and spaced from the stay 201 in the third direction. The sub-stay 202 is contactable with the holder 206. The sub-stay 202 may be made of a sheet of metal and is bent in L-shape. As illustrated in FIG. 10, the sub-stay 202 has a first end surface 202A and a second end surface 202B apart from the first end surface 202A. The first end surface 202A extends in the third direction. The first end surface 202A is located between the second end surface 201B of the stay 201 and the holder 206 in the second direction. The second end surface 202B extends in the second direction, and faces and is spaced from the stay 201 in the third direction.

The first end surface 202A is contactable with the holder 206. The first end surface 202A is spaced from the holder 206, which remain not deformed, in the second direction. The first end surface 202A is located, in the second direction, between the first end surface 201A and the second end surface 201B of the stay 201. The first end surface 202A is contactable with the holder 206 when the holder 206 becomes deformed in response to the urging member 212 urging the stay 201 to the holder 206. A contactable area D of the sub-stay 202 where the first end surface 202A is contactable with the holder 206 is located upstream of the nip N in the third direction. In other words, the contactable area D of the sub-stay 202 is located, in the third direction, upstream of and spaced from an upstream end of the upstream nip N2. When the holder 206 becomes deformed, the sub-stay 202 contacts the holder 206 upstream of the nip N in the third direction. Unlike a structure where the area D is located at a position overlapping the nip N in the third direction, however, the contact between the sub-stay 202 and the holder 206 is less likely to exert an influence on the fluctuations of the pressure distribution in the nip N. The sub-stay 202 can lessen the force with which the holder 206 becomes deformed.

6.6 Urging Members 212

Figure 12:
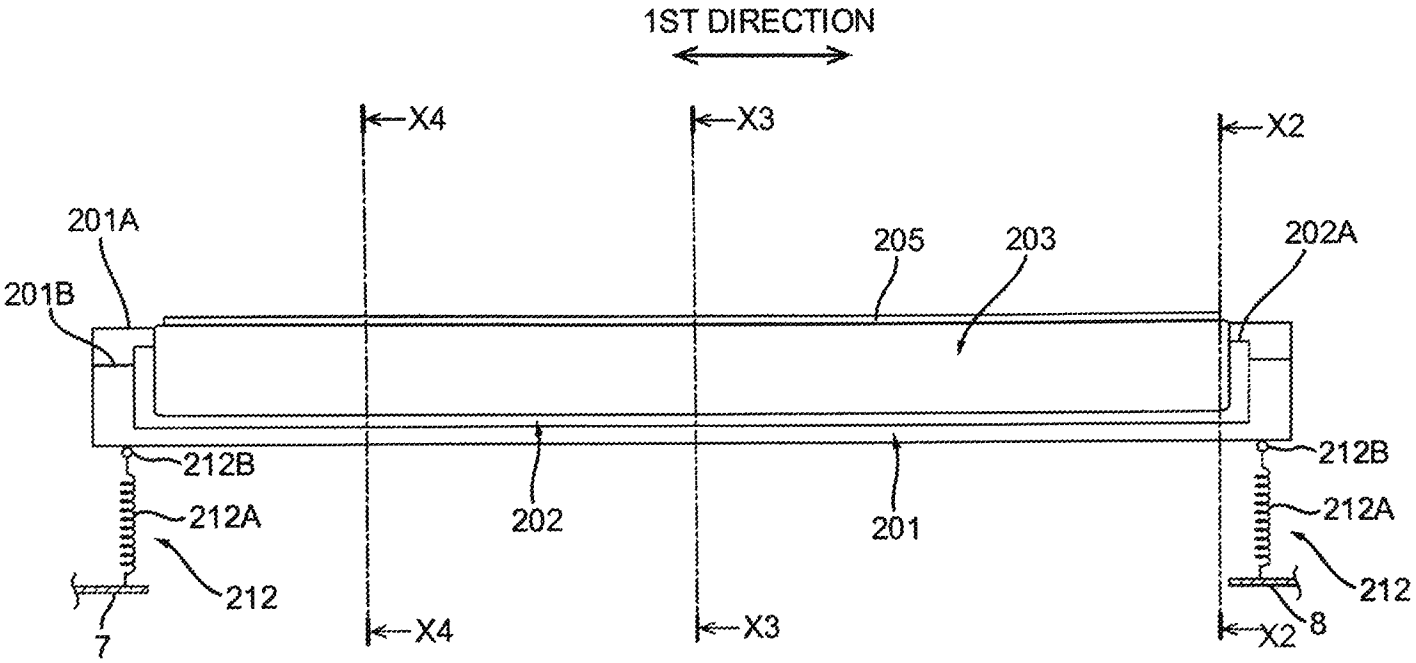
FIG. 12 is a front view of the fixing device illustrated in FIG. 10 from which a heat roller, a belt, and a sliding sheet are omitted.

As illustrated in FIG. 12, the two urging members 212 press the stay 201 toward the heat roller 2. The urging members 212 are spaced from each other in the first direction. Each urging member 212 includes a spring 212A and a contact portion 212B. In other words, the fixing device 200 includes the springs 212A. The springs 212A urge the downstream pad 4 and the upstream pad 205 toward the heat roller 2 via the stay 201. The downstream pad 4 and the upstream pad 205 thus press the belt 3 via the sliding sheet 207 toward the heat roller 2. The springs 212A are helical compression springs each including a plurality of turns of wire. The contact portions 212B are located at respective one ends of the urging members 212. The contact portions 212B contact respective end portions of the stay 201 in the first direction. Respective other ends of the urging members 212 are supported by the side frames.

6.7 Connectors 208 and First Screws 209

Figure 13:
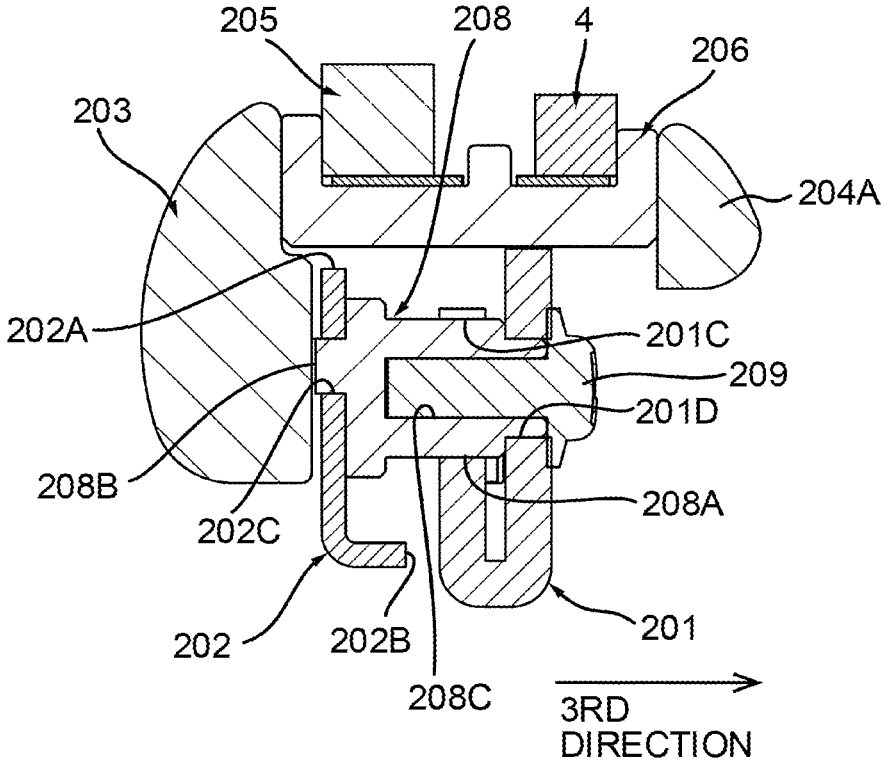
FIG. 13 is a cross sectional view taken along a line X2-X2 of FIG. 12.

As illustrated in FIG. 13, the sub-stay 202 is connected to the stay 201. More specifically, the sub-stay 202 is connected to the stay 201 with the connectors 208 and the first screws 209. The connectors 208 are fixed to the sub-stay 202. Each connector 208 includes a screw-fixing portion 208A and a boss 208B.

The screw-fixing portion 208A is located downstream of the sub-stay 202 in the third direction. The screw-fixing portion 208A extends in the third direction. The screw-fixing portion 208A passes through a first hole 201C and a second hole 201D, which are in the stay 201, in the third direction. The screw-fixing portion 208A has a screw hole 208C extending in the third direction. The boss 208B protrudes from the screw-fixing portion 208A in a direction away from the stay 201. The boss 208B is inserted into a first hole 202C in the sub-stay 202. The boss 208B inserted into the first hole 202C is crimped and deformed. Each connector 208 is thus fixed to the sub-stay 202. The first screws 209 are used to fix the connectors 208 to the stay 201. Each first screw 209 is screwed into a screw hole 208C from an opposite side of the stay 201 to the sub-stay 202.

6.8 Upstream Guide 203 and Second Screws 210

Figure 14:
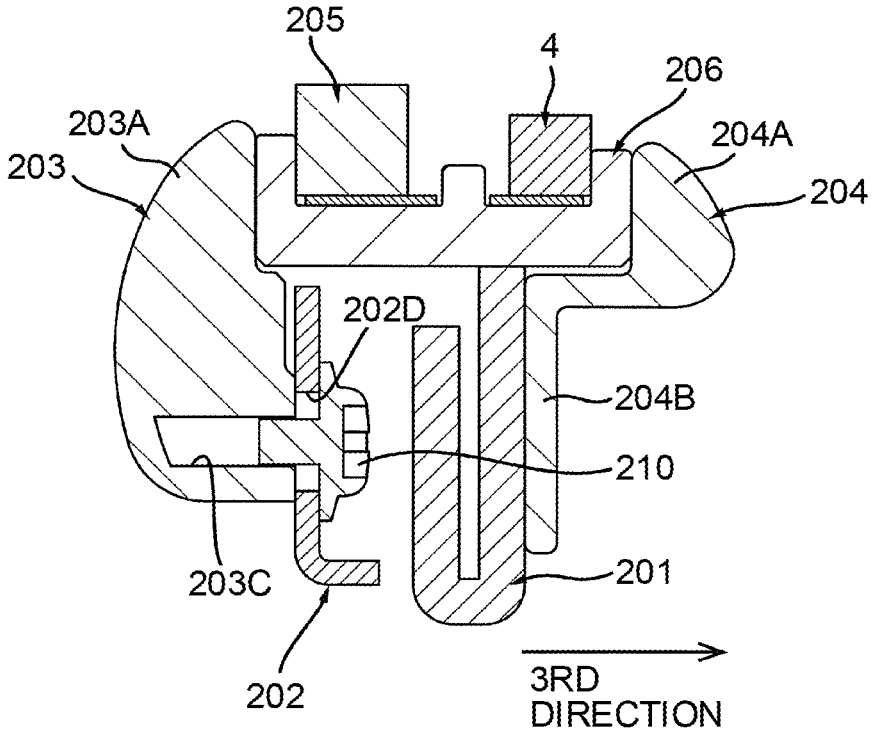
FIG. 14 is a cross sectional view taken along a line X3-X3 of FIG. 12.
Figure 15:
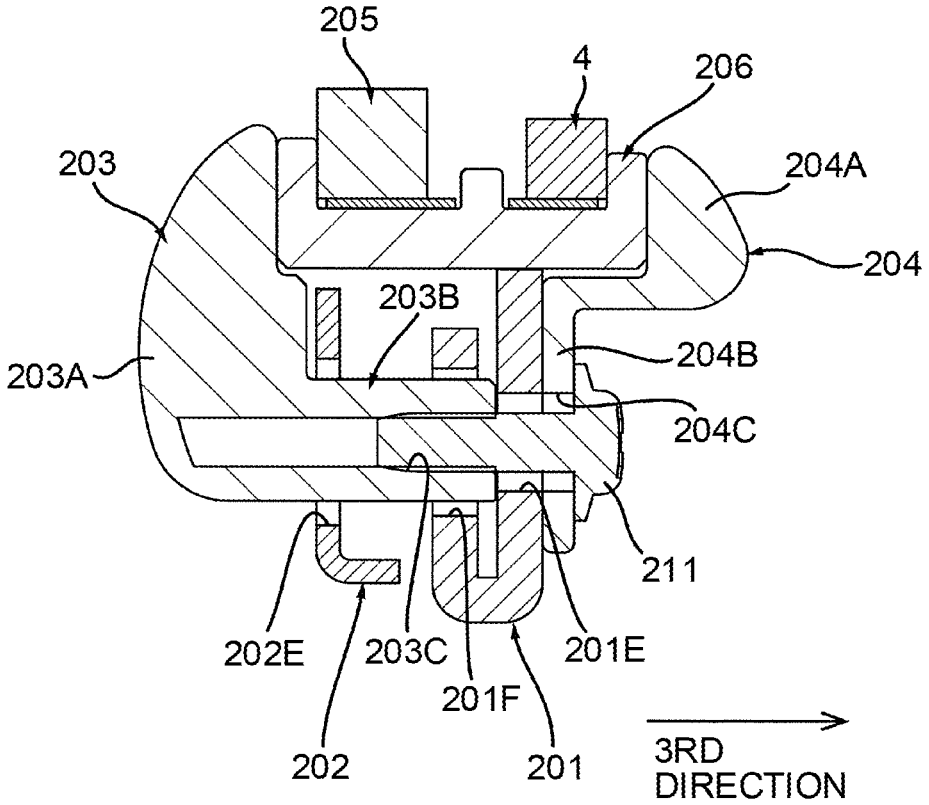
FIG. 15 is a cross sectional view taken along a line X4-X4 of FIG. 12.

As illustrated in FIGS. 14 and 15, the upstream guide 203 includes an upstream guide body 203A and a plurality of screw-fixing portions 203B. The screw-fixing portions 203B will be described in detail later. The upstream guide body 203A is located upstream relative to the upstream pad 205 in the third direction. The upstream guide body 203A guides rotation of the belt 3 via the sliding sheet 207. The upstream guide 203 is fixed to the sub-stay 202. The upstream guide body 203A has a plurality of screw holes 203C. The screw holes 203C communicate with second holes 202D in the sub-stay 202 in the third direction. The second screws 210 are used to fix the upstream guide 203 to the sub-stay 202. Each second screw 210 is screwed into a screw hole 203C from an opposite side of the sub-stay 202 to the upstream guide 203.

6.8 Downstream Guide 204 and Third Screws 211

As illustrated in FIG. 15, the downstream guide 204 includes a downstream guide body 204A and a fixing portion 204B. The downstream guide body 204A is located downstream relative to the downstream pad 4 in the third direction. The downstream guide body 204A guides rotation of the belt 3 via the sliding sheet 207. The fixing portion 204B extends continuously from the downstream guide body 204A. The fixing portion 204B contacts the stay 201. The fixing portion 204B has a plurality of holes 204C. The holes 204C communicate with third holes 201E in the stay 201 in the third direction.

The downstream guide 204 is connected to the upstream guide 203. More specifically, the downstream guide 204 is connected to the screw-fixing portions 203B of the upstream guide 203. The screw-fixing portions 203B extend from the upstream guide body 203A in the third direction. Each screw-fixing portion 203B passes through a third hole 202E in the sub-stay 202 and a fourth hole 201F in the stay 201, in the third direction. Each screw-fixing portion 203B has a screw hole 203C extending in the third direction. The screw hole 203C communicates with the third hole 201E and the hole 204C in the third direction. The third screws 211 are used to fix the downstream guide 204 to the upstream guide 203. Each third screw 211 is screwed into the screw hole 203C from an opposite side of the fixing portion 204B to the screw-fixing portion 203B via the hole 204C and the third hole 201E. The downstream guide 204 may be fixed to the stay 201.

7. Operational Effects of Second Embodiment

As illustrated in FIG. 11, the contact area A between the stay 201 and the holder 206 is located, in the third direction, downstream of the center B of the nip N and upstream of the center C of the downstream pad 4. Thus, the pressure can be set greater in the downstream nip N1 formed by the downstream pad 4 than in the upstream nip N2 formed by the upstream pad 205. The pressure distribution in the nip N in the third direction can be prevented from becoming unstable. The second embodiment may achieve the same operational effects as the first embodiment described above.

8. First Embodiment, Its Variations, and Second Embodiment

The first and second embodiments show but are not limited to that the heat roller 2 as an example of a rotator includes the heater 21 located in the roller body 20. For example, the fixing device may be an externally-heating device including a heater disposed outside of the rotator for heating the outer peripheral surface of the rotator. Alternatively, the fixing device may use the induction heat (IH) process to heat the rotator with induction. Alternatively, the heater may be disposed within an interior space of the belt. In this case, a favorable relationship between the rotator and the belt may be opposite to the above-described relationship. Specifically, the rotator and the belt surrounding the heater may be disposed such that the outer peripheral surface of the belt contacts a surface of a sheet on which a toner image has been transferred and the rotator contacts an opposite surface of the sheet. The fixing device may be disposed in an image forming apparatus including a plurality of photosensitive drums.

What is claimed is:

1. A device comprising:

a rotator;

a belt facing the rotator and having an outer peripheral surface which is configured to contact the rotator to form a nip therebetween;

a first pad configured to press the belt toward the rotator to form one part of the nip;

a second pad configured to press the belt toward the rotator to form another part of the nip;

a holder holding the first pad and the second pad;

a stay supporting the holder; and an urging member urging the stay toward the rotator in an urging direction, wherein the second pad is located upstream of the first pad in a conveyance direction in the nip orthogonal to the urging direction, and wherein at least a portion of a contact area between the stay and the holder is located downstream of a center of the nip and upstream of a front edge of the first pad in the conveyance direction.

2. The device according to claim 1, wherein the second pad is located spaced apart from the first pad in the conveyance direction, and wherein the contact area is located closer to the first pad than the second pad in the conveyance direction.

3. The device according to claim 1, wherein the contact area of the stay is disposed at a non-overlapping position relative to the first pad in the conveyance direction.

4. The device according to claim 1, wherein the first pad includes the front edge and a rear edge downstream of the front edge in the conveyance direction, wherein the front edge supports the belt in contact with the rotator to form the one part of the nip, and wherein the rear edge supports the belt at a position not in contact with the rotator.

5. The device according to claim 4, wherein the contact area is located entirely upstream relative to the front edge in the conveyance direction.

6. The device according to claim 1, wherein the second pad includes an upstream edge and a downstream edge at a position downstream of the upstream edge in the conveyance direction, wherein the downstream edge supports the belt in contact with the rotator to form the other part of the nip, and wherein the upstream edge supports the belt at a position not in contact with the rotator.

7. The device according to claim 1, further comprising a sub-stay located upstream of the stay in the conveyance direction and being contactable with the holder at a contactable area, wherein the contactable area is located upstream of the nip in the conveyance direction.

8. The device according to claim 7, wherein the contactable area is located at a position overlapped with the second pad in the conveyance direction.

9. The device according to claim 1, further comprising:

a side frame supporting an end portion of the rotator; and a bracket including a support portion which supports an end portion of the stay movably in the urging direction, wherein a mounting position of the bracket relative to the side frame in the conveyance direction is adjustable.

10. The device according to claim 9, wherein one of the bracket or the side frame includes a guide slot and the other of the bracket or the side frame includes a guide protrusion that is received by the guide slot, the guide slot having an elongated length in the conveyance direction.

11. The device according to claim 9, wherein the holder includes a holder protrusion extending through the side frame, and wherein the support portion of the bracket includes a hole into which the holder protrusion is inserted, the hole having a greater dimension than the holder protrusion in the urging direction.

12. The device according to claim 9, wherein the holder comprises a holder body supporting the first pad and the second pad and a holder protrusion protruding from the holder body in a width direction, the width direction being a direction parallel with an axis of the rotator, wherein the stay comprises a stay body contacting the holder body and an insertion portion protruding from the stay body in the width direction and inserted into the holder protrusion, and wherein the support portion comprises a hole into which the holder protrusion is inserted, and the hole has a greater dimension than the holder protrusion in the urging direction.

13. The device according to claim 12, wherein the side frame is located between the holder body and the bracket in the width direction.

14. The device according to claim 1, wherein the second pad is softer than the first pad.

15. The device according to claim 1, further comprising a heater configured to heat the rotator.

16. The device according to claim 15, wherein the heater is positioned within the rotator.

17. A fixing device comprising:

a roller having a rotation axis extending in an axial direction;

a heater positioned within the roller;

a belt facing the roller and having an outer peripheral surface which is configured to contact the roller to form a nip therebetween;

a first pad configured to press the belt toward the roller to form one part of the nip;

a second pad configured to press the belt toward the roller, to form another part of the nip;

a holder holding the first pad and the second pad; and a stay supporting the holder, the stay receiving an urging force urging the stay toward the roller in an urging direction, wherein the second pad is located upstream of the first pad in a conveyance direction in the nip orthogonal to the urging direction and the axial direction, and wherein a contact area between the stay and the holder is located entirely downstream of the second pad and at least partially upstream of the first pad in the conveyance direction.

18. The fixing device of claim 17, further comprising a spring configured to apply the urging force to the stay.

* * * * *